US006090243A

United States Patent [19]

Corbellini et al.

[11] Patent Number: 6,090,243

[45] **Date of Patent: *Jul. 18, 2000**

[54] PROCESS FOR PREPARING A WEB OF PAPER FIBERS

[76] Inventors: Glauco Corbellini, 33100 Via Carducci 48, Udine, Italy; Peter A. Rodriguez, 1785 Selva Marina Dr., Atlantic Beach, Fla. 32233

[ * ] Notice: This patent is subject to a terminal disclaimer.

[21] Appl. No.: 08/868,501

[22] Filed: Jun. 4, 1997

Related U.S. Application Data

[60] Continuation-in-part of application No. 08/660,079, Jun. 3, 1996, Pat. No. 5,647,959, which is a division of application No. 08/395,059, Feb. 27, 1995, Pat. No. 5,522,969, which is a division of application No. 08/116,400, Sep. 3, 1993, Pat. No. 5,393,382, which is a division of application No. 07/717,880, Jun. 17, 1991, Pat. No. 5,242,547, which is a continuation of application No. 07/384,744, Jul. 24, 1989, abandoned.

[51] Int. Cl.[7] ..... D21F 1/48; D21F 5/14

[52] U.S. Cl. ..... 162/206; 34/454; 162/207; 162/211; 162/217; 162/359.1

[58] Field of Search ..... 162/207, 206, 162/211, 217, 359.1, 358.1; 34/111, 116, 454

[56] References Cited

U.S. PATENT DOCUMENTS

| | | | |
|---|---|---|---|
| 3,224,928 | 12/1965 | Lee et al. | 162/359.1 |
| 3,691,010 | 9/1972 | Krake | 162/359.1 |
| 4,302,282 | 11/1981 | Young | 162/111 |
| 4,561,939 | 12/1985 | Justus | 162/360.2 |
| 5,064,503 | 11/1991 | Tavi | 162/359.1 |
| 5,393,382 | 2/1995 | Corbellini et al. | 162/351 |

*Primary Examiner*—Karen M. Hastings
*Attorney, Agent, or Firm*—Arthur G. Yeager

[57] ABSTRACT

Improved method of removing water from a wet web of paper includes the steps of (a) passing the web and its supporting fabric above and in sliding contact with a surface of a meniscus separator unit having a plurality of spaced cells in contact with the inner surface of the fabric; (b) applying a small vacuum to an internal space of each cell to extract water from the web using the tension meniscus of water while preventing air from passing through the web; and (c) permitting air from the atmosphere only to be applied to the inner surface of the fabric by each cell and thence into the fabric to replace water removed from the fabric in step (b) thereby enhancing the removal of water from the web and from the fabric, the atmospheric air passing along and through the interstices between the inner and outer surfaces of the fabric to the internal space of each cell. The air from step (c) travels in an inclined path from the fabric inner surface toward the direction of fabric travel and thence through the fabric in the latter direction, and the air from step (c) is removed through an inclined path away from the fabric. The fabric may be a Fourdrinier wire fabric, a felt fabric, or other fabric. In most uses a moving surface is located on the outer surface of the wet web of fibers opposite to the meniscus separator unit.

23 Claims, 4 Drawing Sheets

PROCESS FOR PREPARING A WEB OF PAPER FIBERS

RELATED PATENT APPLICATIONS

This is a continuation-in-part of application Ser. No. 08/660,079, filed Jun. 3, 1996, now U.S. Pat. No. 5,647,959; which is a division of Ser. No. 08/395,059, filed Feb. 27, 1995, and issued as U.S. Pat. No. 5,522,969; which is a division of Ser. No. 08/116,400, which was filed Sep. 3, 1993, and issued as U.S. Pat. No. 5,393,382; which is a division of Ser. No. 07/717,880, filed Jun. 17, 1991, and issued as U.S. Pat. No. 5,242,547; which is a continuation of Ser. No. 07/384,744 which was filed Jul. 24, 1989, and is now abandoned.

TECHNICAL FIELD

This invention relates to the technical art of paper making and to the machinery used in that art.

BACKGROUND OF THE INVENTION

Modern paper making processes and machinery follow the Fourdrinier method wherein an aqueous dispersion of paper making fibers is poured onto a high speed travelling woven fabric through which water from the dispersion drains leaving a thin web of wet fibers which is dried and finished to a sheet of paper. The key step in this method is that of forming the web from the fiber/aqueous dispersion. This must be done very quickly and uniformly across the width of the endless fabric. Normally, the transition of dewatering commences by gravity, followed by other means such as foil blades, continuing with a plurality of controlled low vacuum boxes and then by a plurality of high vacuum boxes. There are many causes for mishaps to occur that prevent the final sheet of paper from being perfect. One of the principal causes is that air may penetrate the web of paper and the fabric causing nonuniformities in the paper. Such disturbances may be caused by nonuniform drainage at every square inch of the fabric surface, and entrainment of air in the fiber/aqueous dispersion, followed by forcing air through the dispersion and fabric whereby air will find the path of least resistance and fixing the flocculation of such dispersion unevenly over the fabric. The demand for higher and higher speed makes it increasingly difficult to produce a paper sheet that is isotropic.

The critical step of this process is the water removal, which must be done quickly and uniformly in order to obtain a layer of fibers on the fabric that can be finished to a high quality paper. The principal difficulty in producing a fast uniform drainage has been that when the drainage is speeded up by applying a vacuum there are numerous instances at random locations across the fabric where air will be pulled through the layer of wet fibers. At each location a small vortex appears to break the continuity of the film of water and fiber on the fabric, and to permit the passage of air through the entire film and thereby disrupting the uniform settling of the fibers into a web of uniform thickness and strength. Every time such an instance occurs, a meniscus is formed at the interface of the water and air and this is an obstruction to the free uniform flow of water away from the fibers forming the web. The formation of such air holes through the mass of fibers forming the web must be minimized if any improvement in sheet formation at high speed is to be achieved.

It is an object of this invention to provide improved sheet formation in the Fourdrinier paper making process. It is another object of this invention to provide an improved procedure for maintaining a continuous drainage of water with substantially no air flow discontinuities occurring in the forming web. It is an object of this invention to provide a drainage process wherein all of the web forming fibers are essentially submerged in water until the last moment when the last portion of water is drained away from all parts of the web simultaneously. A further object is to improve the drainage while maintaining a higher retention of fines and filters in the web than heretobefore accomplished. For example, the prior art mills may have a first pass retention of between 4–60 percent whereas this invention provides first pass retention of up to 90 percent. Another object is to decrease the amount of friction between the fabric and the dewatering components to increase the fabric life. A further object is to substantially reduce the length of the forming area of the Fourdrinier fabric, thereby reducing the number of dewatering components required. For example, one submerged drainage box in accord with this invention may replace 20–25 foils of the prior art and in substantially less space along the length of the fabric. An additional object is to improve the sheet formation by decreasing its porosity and substantially eliminating pin holes through the sheet. Another object is to decrease the power consumption of the Fourdrinier machine in both driving the fabric and by eliminating high vacuum pumps to supply suction to the dry end flat boxes thereof.

Yet other objects include:

A. retention of more chemical additives and fines due to the more gentle dewatering and uniformity of dewatering;

B. easier release of web from the fabric due to the web not being forced into the interstices of the fabric by high vacuum whereby a web pick-up vacuum roll or high pressure air from below the fabric not needed;

C. amount of defoamer is reduced;

D. enhanced sheet strength; and

E. enhanced drying at the drier end of the fabric (couch roll) thus reducing the power used in the press and/or the drying sections. Still other objects will appear from the more detailed description which follows.

BRIEF SUMMARY OF THE INVENTION

These definitions may be used in understanding this invention:

A. Meniscus is the surface area of a water volume which is in contact with unlike surfaces being either the container holding the water or the gases in contact with a surface of the water or surrounding the water, such as air when a drop of water is falling through it. Webster's New International Dictionary, 2nd Edition, Unabridged, 1934 defines Meniscus as—the curved upper surface of a liquid column that is concave when the containing walls are wetted by the liquid and convex when not. However, the meniscus also is present at the interface between the liquid and the vessel in which it is contained.

B. Surface Tension is a condition that exists at the free surface film of a liquid by reason of intermolecular forces about the individual surface molecules and is manifested by properties resembling those of an elastic skin under tension. Surface Tension is a characteristic of the water meniscus which can be modified by chemical means. The meniscus changes its geometric (concave) shape depending on the size of the vessel containing the fluid. In capillary tubes the meniscus reaches extremely high levels of energy in the form of pressure. The resistance of the meniscus to rupture, compared to it's thickness is very high as is well known.

C. Draining by eliminating the meniscus, or submerged drainage, is a water removal operation whereby water is removed from the aqueous dispersion or wet web by means of a reduction of pressure originating from, and transmitted by the water and not by the prior art vacuum as may be provided in the wet and drier end of a Fourdrinier fabric. In particular, the meniscus is eliminated in the surface of the fabric opposite to the pulp or web so that drainage is unimpeded.

D. Meniscus Separator Unit (MS unit) is the apparatus of FIGS. 3–6 of this invention which basically is one-half of apparatus shown in FIGS. 2–10 of U.S. Pat. No. 5,389,207, i.e., the half above or below the Fourdrinier wire 21 or 39 which supports the web of pa per fibers 44. This MS unit comprises three cells 50 each having a water drainage outlet 49, an air inlet 48, and a nose 51 (see FIG. 4) that is in contact with the Fourdrinier wire separating the MS unit from the wet web of paper fibers. The MS unit is not limited to three cells and may in certain embodiments of this invention have from 1–6 or more cells, although three cells appears to be suitable for most situations, since other MS unit cell arrangements may be employed upstream or downstream from any MS unit under consideration. In the process of this invention only the MS unit is used (i.e., one half of the meniscus tension unit shown in FIG. 2 of U.S. Pat. No. 5,389,207). The MS unit may be used in series with other MS units anyplace in the formation and drying portions of the paper making process. In each MS unit cell there is one passageway for conducting air to its drainage surface and to the inner surface of the fabric, and another passageway communicating over the drainage surfaces with the other passageway through interstices of the fabric. There also is a means for applying a small vacuum to the internal surface to modify the natural tension of the meniscus of water in the fabric so as to induce by capillary forces enhanced drainage of water from the paper web to the fabric and then into the internal space of the MS unit cell, and means for discharging the water and air from the internal space in the MS unit cell.

This invention relates to a method for removing water from an aqueous dispersion of fiber formed into a wet web in contact with a single moving porous support, such as a fabric, including a horizontal Fourdrinier fabric or wire in a paper making process. More specifically this invention relates to a method for continuously removing water from an aqueous fiber dispersion formed into a wet web in contact with an outer surface of a single moving fabric, including a horizontal Fourdrinier fabric in a paper making process having a wet end portion and a dry end portion. This method includes the sequential steps of (1) passing a wet web of fibers and the supporting fabric in sliding contact with a MS unit having internal cells, (2) applying a small vacuum to the cells so as to draw water from the web into the cells and replace the water in the fabric with air.

This invention includes a paper-making process employing a fabric, including a Fourdrinier wire or fabric, drying felt or the like wherein the removal of water from the web in the drier end of the process is accomplished by the exclusive use of one or more MS units at any selected locations along the travel of the drying web of paper.

SUMMARY OF THE INVENTION

This invention relates to a method of removing water from a wet web of fabric material which has the following steps: (a) passing the fabric material surface in sliding contact with a working surface of a meniscus separator unit having a plurality of internal cells communicating with passageways in the working surface; (b) applying a small vacuum to an internal space in each cell adapted to extract water from a wet web of fibers on another surface of the fabric material while inhibiting air from passing through the web of fibers; and (c) permitting air from the atmosphere only to be applied to the other surface of the fabric material by each cell and thence into filaments of the fabric material to replace water removed from the web of fibers, the atmospheric air passing along and through the interstices between the surfaces of the fabric material to the internal space of each cell.

In other aspects, the fabric material carries a wet fibrous web of paper on its other surface not in sliding contact with the working surface of the unit. The meniscus separator unit may be located in any section of a Fourdrinier paper making process consisting sequentially of a wet section, a drier section, a press section, and a dryer section. Preferably, a plurality of additional meniscus separator units are spaced along the drier section. The meniscus separator unit may have a curved surface engaging the fabric and the location where the wet web engages a stoned roll in the press section.

An additional separator unit may have a surface in sliding contact with an outer surface of the fabric in the press section of the paper making process to dry and condition its outer surface.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
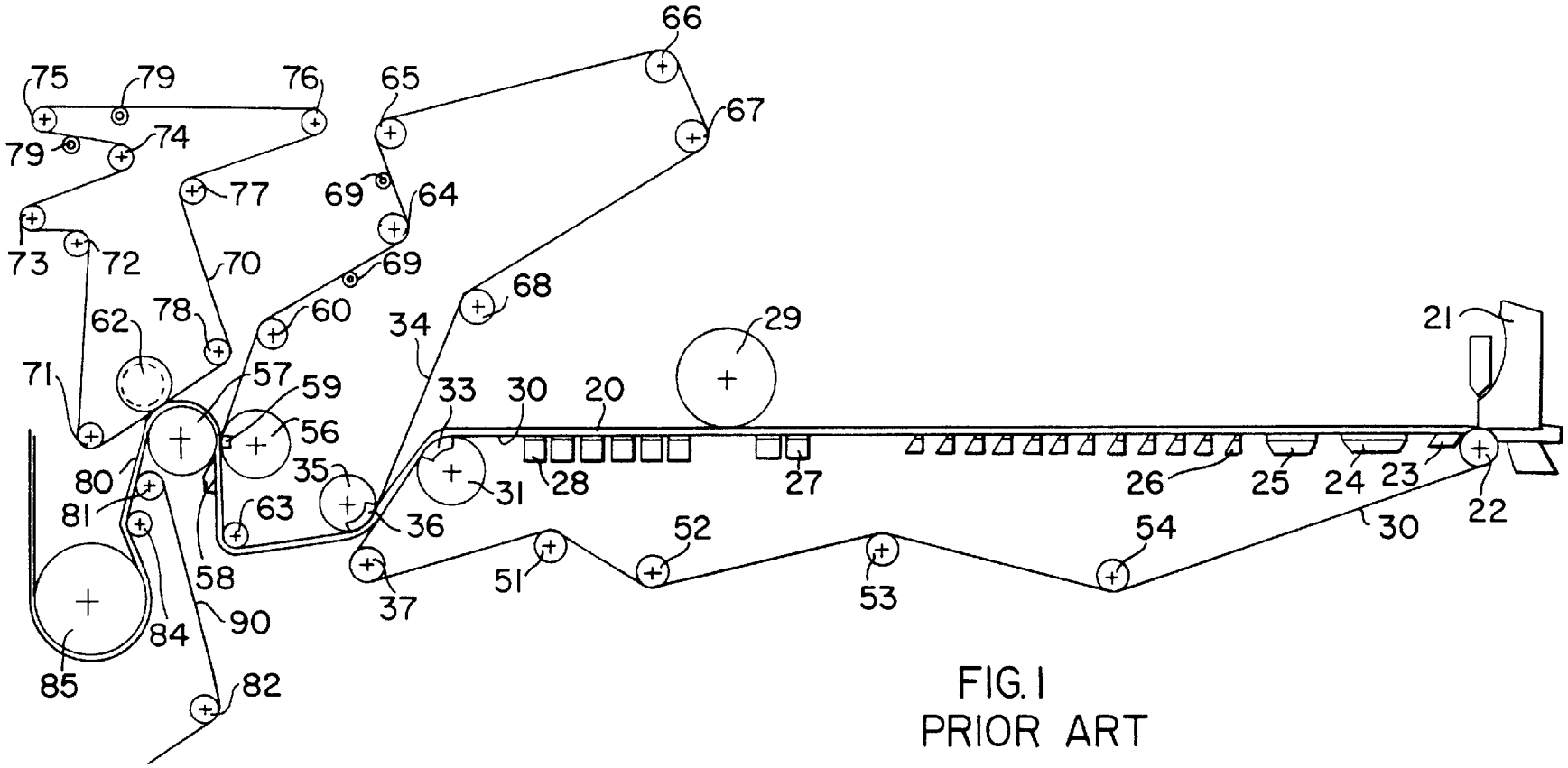
FIG. 1 PRIOR ART
FIG. 1 is a schematic diagram of a single wire Fourdrinier process for making paper according to the prior art.

Our U.S. Pat. No. 5,242,547 describes and claims an improved system for controlling the forming and dewatering of a web of paper fibers by submerged drainage in which air does not penetrate the fiber/aqueous dispersion or the formed web. The dewatering is accomplished by altering the natural tension of a meniscus of the water to induce enhanced drainage of water from the aqueous dispersion of paper making fibers in the wetter end of the system. This improved horizontal system also provides substantially equal side surfaces to the paper formed in such system.

Our U.S. Pat. No. 5,389,207 describes and claims an improved apparatus for controlling the dewatering of a web in a Fourdrinier fabric by submerged drainage apparatus in which air does not penetrate through the fiber/aqueous dispersion nor the formed web. The dewatering is accomplished by altering the natural tension of the meniscus of the water to induce enhanced drainage of water from the aqueous dispersion of paper making fibers in the fabric and replacement air for the water draining from the formed web is provided from beneath the lower fabric and, if an upper fabric is employed, from above the upper fabric.

The process and apparatus of both of those patents operate under the same physical laws, but the former is used only for forming the web in the beginning of the process, and the latter can be installed at any point of the process: in the wet end, in the press section, and in drying end. The former patent deals with the process of "submerged drainage", the latter patent employs an apparatus known as the MS unit.

For better explanation of the various applications of the MS unit it is necessary to review the basic concepts of the meniscus of the water. We have previously explained that the word "meniscus" means the surface of volume of water which is in contact with a dissimilar surface, e.g., glass or air. As an illustration: in a glass of water resting on a horizontal table, a volume of water has the bottom and lateral surfaces in contact with the glass, while the top surface is in contact with air. Therefore, the external surface of that volume of water assumes the shape and size of the container while internal of the volume of water is another surface containing the volume of any body immersed in the water; these two types of surfaces: an external meniscus, and an internal meniscus, are found everywhere, and exert some control over all life in our planet. These controls are particularly important in the process of paper manufacturing. The word "meniscus" indicates the external surface of a volume of water and also the internal surface of that volume in contact with the immersed bodies. These surfaces are the "external meniscus" and the "internal meniscus". The expressions, "surface tension" or "meniscus tension" indicate one characteristic of the meniscus which is proportional to a force which generates the phenomenon of capillary action, which causes water to penetrate porous bodies in an opposite direction to the force of gravity. As an illustration, in the trees and plants, the capillary forces cause liquid to rise from the roots to the leaves. In the paper making process the surface tension of water impedes the air from penetrating the paper web. The meniscus grips the wire filaments of the screen as a film, which does not permit air to penetrate, although that film can be broken when the air pressure reaches a critical valve. The surface tension of water can be modified by chemically changing the characteristics of the liquid water. In the paper manufacturing process, at the wet end of the process, during the drainage operation across the horizontal wet wire, the meniscus film of the water at the bottom surface of the wire fabric does not permit a natural drainage due to the fact that for each minute volume of water leaving the wire a corresponding minute volume of air would have to penetrate the wet wire fabric from the top, but this does not occur. However, an irregular and limited drainage does occur because below the bottom surface of the wire fabric some drops protrude beyond the geometrical line of this surface and become micro siphons that are elastically stretched until the meniscus film breaks. The breaking of the meniscus film by air happens when the pressure reaches a value corresponding to approximately 20 cm. water column, with the result that there is drainage by gravity which involves a vacuum making it very difficult to control the drainage due to the elasticity of 20 cm. of surface tension of the meniscus, and finally air penetrates limited areas of the web damaging the formation of the web. Experiments were made examining the tension of the meniscus at ambient atmospheric pressure 0. It was found that the meniscus tension is not greatly influenced by the reduction of atmospheric pressure and the capillary pressure works well at zero atmospheric pressure. This discovery explains some of the reasons for the successful operations of the MS unit in this invention. This apparatus is shown in the U.S. Pat. No. 5,389,207 in operation with a two-wire fabric system. It has been found to work well even with a single fabric wire. The MS unit can be installed at each point of the process taking care to supply to the apparatus sufficient vacuum to prevent penetration of the web by air.

Figure 3:
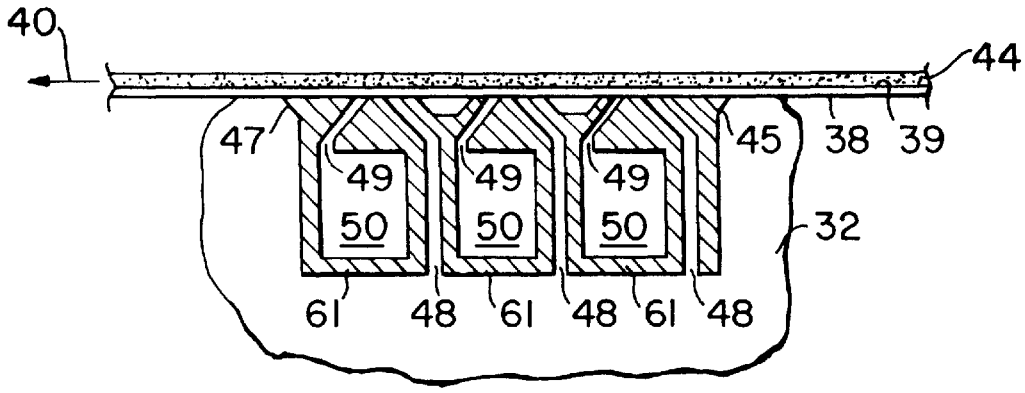
FIG. 3 is a cross-sectional view of a MS unit as applied to a moving web of wet fiber pulp in a Fourdrinier paper making process.

In FIG. 3 the MS unit is installed under a single wire fabric 38, supporting web 44. Good enough results are obtained, if the vacuum in cell 50 is not strong enough to pull air through the web 44. Air enters through the channel 48 crossing below the outer face of wire 38 running in the direction of the movement of the wire to the left between the wire and the MS unit and is discharged through channel 49 into cell 50. The speed of the wire is high enough to dislodge the meniscus and all the small water drops, thus maintaining maximum porosity of the wire to use the capillary energy for removing the water from the web. A set of three cells attached to each other to form an MS unit provides an acceptable performance in which the last downstream cell is nearly empty. A plurality of MS units should be installed so as to produce a web which has a consistency of about 20% dryness. When the dryness of the web reaches about 20% the effectiveness of MS unit decreases in that it loses its capability to remove more water. At this point the internal meniscus of the water and the external meniscus are joined together and the small amount of water remaining internal in the web can be extracted only with the use of some pressure. Practically, the web will be pressed between the surfaces of two or more cylinders against a felt which will receive the water and then carry this water to the felt conditioner. This operation, usually made three times in three different presses, is very expensive and produces a return only to the point of drainage. Transferring the web from the Fourdrinier fabric to the fabric felts of the presses is accomplished by using a pickup with vacuum located in a suction chamber installed inside a drilled cylinder, the felt and the wire, being in contact during the motion over the drilled cylinder and its suction chamber, can transfer the web from the wire fabric to the felt fabric by means of the extractive force of vacuum coming through the felt. It is necessary to install a MS unit before this point to clean the wire fabric removing the residual water held among the filaments hence inhibiting this water from returning into the web during the transfer of the web from the wire to the felt.

FIG. 1 shows a traditional horizontal Fourdrinier process and apparatus with head box 21, breast roll 22, forming board 23, hydrofoil boxes 24 and 25, twelve changeable-angle single foil boxes 26, seven suction boxes 27 to 28, a cylinder dandy 29 for making better sheet formation of paper fiber web 20 on the wire support 30. Roll 31 has a drilled mantel and a suction chamber 33 that provides a high suction. The web 20 is then contacted by felt 34 as it passes over cylinder 35 in the contact area of suction box 36. Wire 30 is then returned to head box 21 via rolls 37, 51, 52, 53, 54, and breast roll 22 to make a complete circuit. Web 20 is forced, via suction box 36, into contact with felt 34 on roll 35 and thence via roll 63 to the first press operation comprising roll 56 pressing against granite roll 57. Web 20 is pressed into felt 34 causing moisture from web 20 to pass into felt 34. Steam diffuser 58 directs steam into web 20 and felt 34 causing moisture from web 20 to pass into felt 34. Steam diffuser 58 directs steam into web 20 and felt 34 which is taken up by suction box 59 in cylinder 56. Squeezed web 20 and felt 34 produces water at about 50 degrees C which is sucked into box 59. Beyond this point web 20 and felt 34 are separated, the felt going to roll 60 and the web remaining on granite roll 57. The temperature of roll 57 is about 50 degrees C. Web 20 is squeezed between roll 57 and cylinder 62 which has a channeled surface allowing for easy removal of water squeezed out of web 20. Felt 34 is led off through a circuit of rolls 60, 64, 65, 66, 67, 68 and back to roll 35. In this circuit is felt conditioner 69 which extracts water from the felt 34. A second felt 70 travels through the circuit of cylinder 62 and rolls 71, 72, 73, 74, 75, 76, 77 and 78 back to cylinder 62. Felt conditioner 79 is in the circuit to remove water from the felt 70. The squeezed web 80, as it leaves granite roll 57 is guided by roll 81 into contact with felt 90, arriving via roll 82, and the combined web 80 and felt 90 is directed to roll 84 and then to drying cylinder 85 and on to the remainder of the drying section (not shown).

Figure 2:
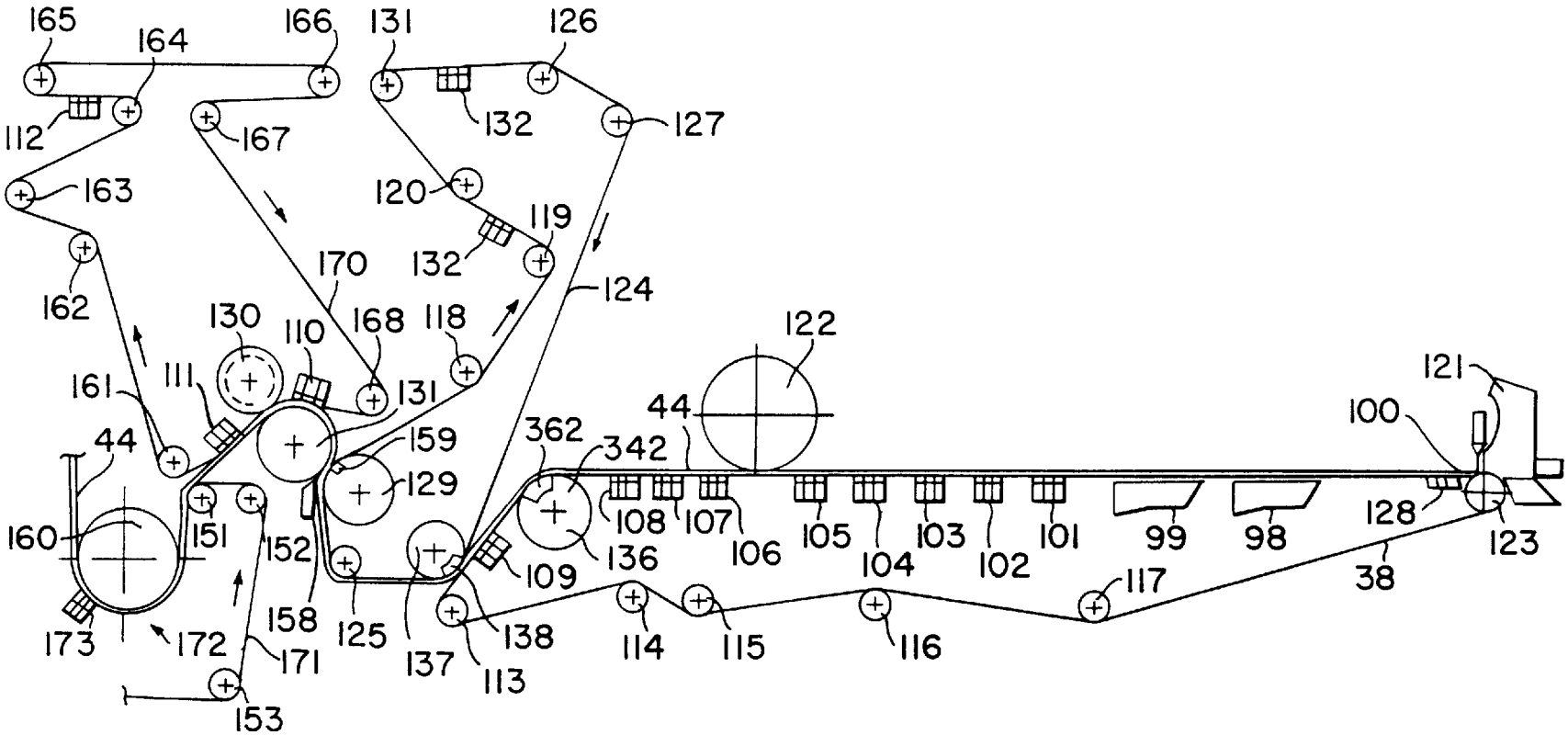
FIG. 2 is a schematic diagram of the method of this invention employing meniscus tension units (herein referred to as MS units) for the removal of water from the wet web of fibers in a Fourdrinier process for making paper.

In FIG. 2 web 44 and wire 38 are similar to web 20 and wire 30 of FIG. 1. In FIG. 2 pulp 100 is delivered through head box 121 to forming board 128, having an MS drainage unit below fabric wire 38, and then over two submerged drainage apparatus 98 and 99 to produce a web of approximately 5% dryness. This web then passes over a succession of MS units 101–108 and cylinder dandy 122 which continue the drying process such that the web at roll 136 has a dryness of approximately 20%. Web 44 passes to suction pickup roll 137 after joining fabric felt 124 and then is passed over MS unit 109 to remove any residual water. The fabric wire 38 is then returned via rolls 113–117 to breast roll 123. Web 44 and fabric felt 124 are joined at cylinder 137 passing suction box 138 and then to roll 125 to enter the first press section formed by roll 129 and stone roll 130. Moisture from web 44 passes into felt 124. Steam diffuser 158 passes steam into felt 124 and web 44 and suction box 159 removes that moisture. Before felt 124 is separated from web 44 and carried around the circuit of rolls 118, 119, 120, 131, 126 and 127. In that circuit are MS units 132 to assist in drying felt 124 and facing the felt. Temperatures are about the same as described above with respect to FIG. 1. A second felt 170 travels the circuit of cylinder 130 and rolls passing MS units 110 and 111 which assist in drying the second felt 170. Squeezed web 44 leaving granite roll 130 is joined by felt 171 passing around rolls 151 and 152 to approach drying cylinder 160 and on to the remainder of the drying section (not shown). An MS unit 112 may be employed to extract water from felt 170 after cleaning (not shown) and to condition the face of the felt 170 resulting in longer life of the felt due to the use of less vacuum to extract water therefrom, i.e., the fibers of the felt remain intact with the felt and have a smoother face contacting the paper web.

Figure 4:
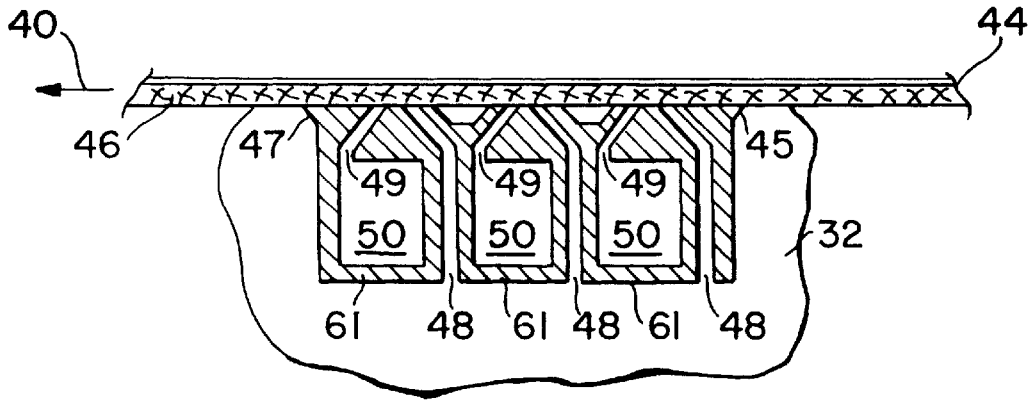
FIG. 4 is a cross-sectional view similar to FIG. 3 showing a drying felt fabric or thermal wire as a second embodiment.
Figure 5:
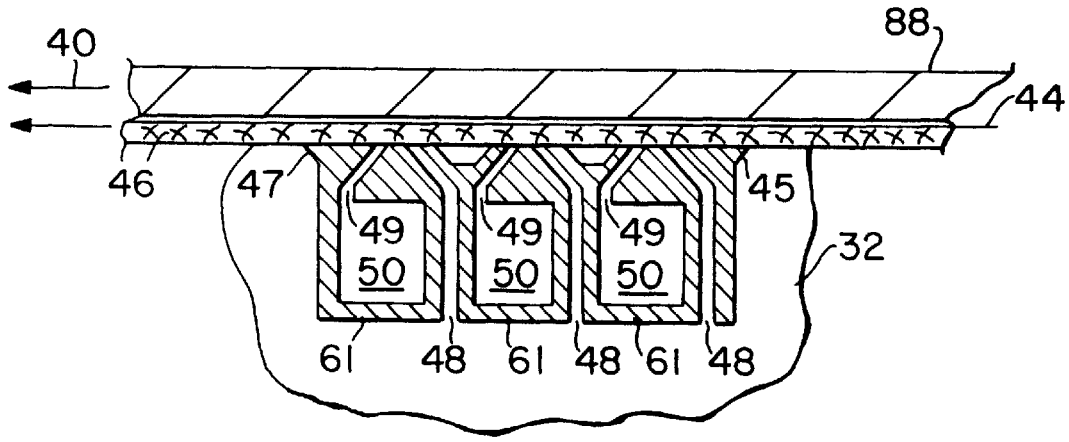
FIG. 5 is a cross-sectional view similar to FIGS. 3 and 4 showing a drying felt underlayer (as in FIG. 4) and a heated body as an overlayer to the fibrous web as a third embodiment.

In FIGS. 3, 4 and 5 there are shown various installations of MS units at various points in the paper making process. FIG. 3 illustrates the use of an MS unit at the bottom surface of a horizontal Fourdrinier wire 38, while the top surface 39 is covered by the paper web 44. Each MS unit has three or more cells 61 with a leading edge 45 and a trailing edge 47 and the upper surface of all cells 61 in contact with the bottom surface of fabric or wire 38. Each cell 61 has an inlet channel 48 leading to fabric or wire 38 and an outlet channel 49 leading to internal space 50. This arrangement permits the extraction of water from the pulp in web 44 while maintaining good sheet formation control and good retention of web 44. It is possible, therefore, to install MS units at any point in the Fourdrinier process prior to the separation of web 44 from wire 38. Web 44 is continuously cleaned by the capillary forces generated in the body of wire 38 by aerodynamic effects produced by the jet of air penetrating into the interstices and along the filaments of the body of the wire from channel 48 in the MS unit. After penetrating through the body of the wire moving in the direction 40, the air crosses the bottom surface of wire 38 and exits through channel 49 into interior space 50 of cell 61. The movement of air through and along the wire 38 collects a high percentage of the water in the cells 61 of the MS units. This water is eliminated from cells 50 by using a small vacuum as described in our U.S. Pat. No. 5,389,207.

In FIG. 4 there is shown an MS unit installed in contact with the lower surface of a fabric or felt or a special thermal wire 46, while the upper surface supports paper web 44. This arrangement may be used in the press section of a paper making machine, even if the position is not horizontal, web 44 and felt or thermal wire 46 moving in the direction of arrow 40.

In FIG. 5 web 44 is in contact with a hot surface of a body 88 moving in the same direction 40 as is web 44 and felt 46, the latter being in contact with an MS unit as shown in FIGS. 3 and 4. This system is also operable in all positions whether horizontal or not.

Figure 6:
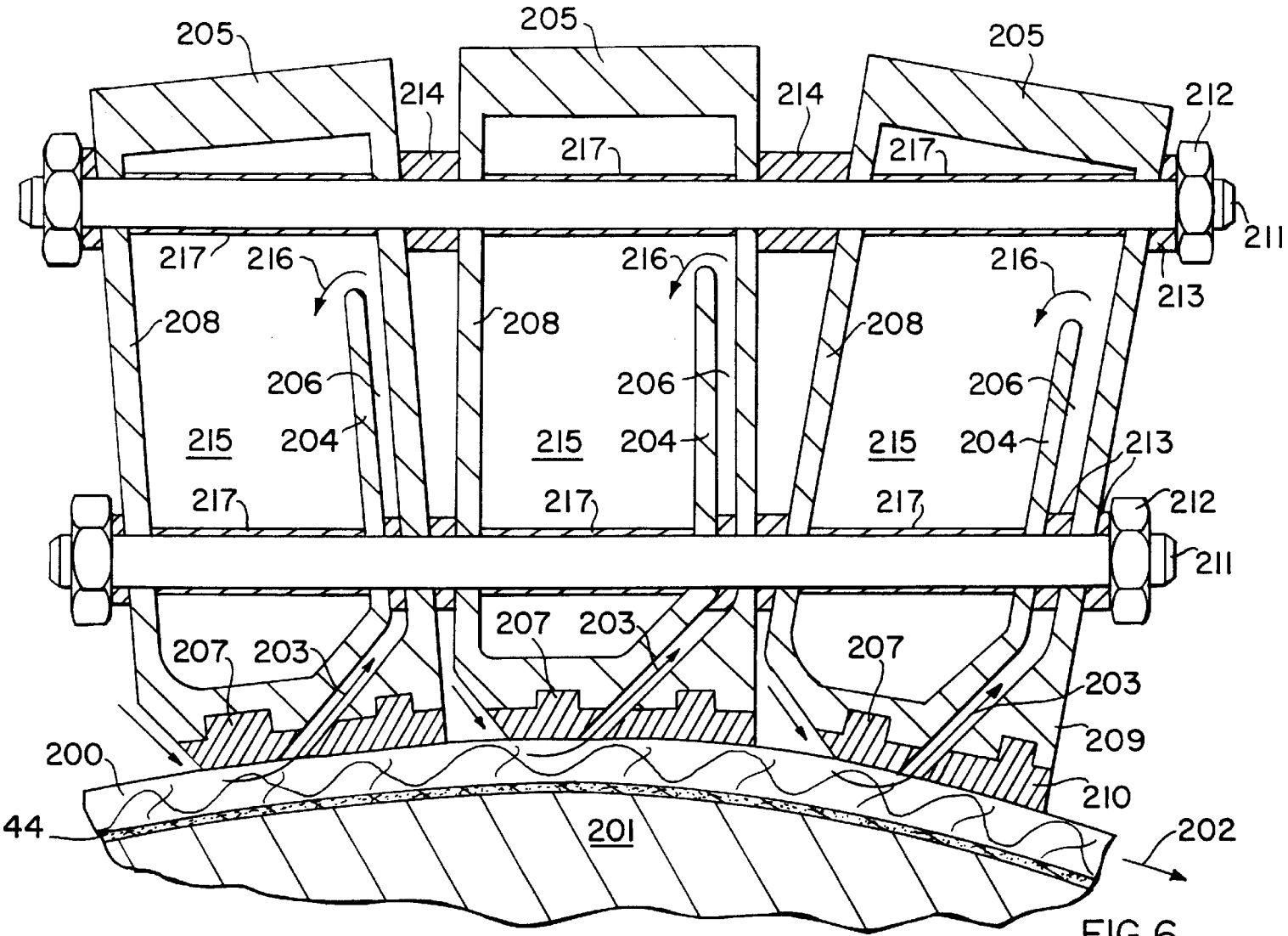
FIG. 6 is a cross-sectional view of a modified MS unit for application to the outside of a roller having a layer of felt outside of the wet fibrous web which lies directly against the roller; as a fourth embodiment of the process of this invention.

In FIG. 6 there is shown an MS unit in contact with the convex surface of a cylinder press, or the like. Dryer cylinder 201 supports paper web 44, covered by felt 200, and an MS unit placed to bear against the outside surface of felt layer 200. Cylinder 201, web 44, and felt 200 move together in the direction of arrow 201 while the MS unit is stationary. In the case of a dryer cylinder felt 200 wraps around about two thirds of the cylinder surface. In the case of a press cylinder the surface covered by felt 200 is only that necessary to cover the contact area of the MS unit illustrated in FIG. 6. Channel 206 communicates between the nose of the cell which contacts felt 200 and the interior 215 of the cell, which is made of stainless steel, carbon fiber-reinforced plastic, or the like. Each cell is enclosed by walls 205, and 208 with the nose at 207 and 210 in contact with felt 200, the nose portions being made of hardened material that resists wear. The cells are held together by tie rods 211 in sleeves 217 and nuts 212 and spacers or washers 213. Water from web 44 is drawn into felt 200 and into channel 206 by capillary forces, and the vacuum produced by such water removal is relieved by the jet or air entering at nose 207 and passing through felt 200 to be discharged through channel 206 in the direction of arrow 203 into the interior of cell 215 exiting channel 206 at 216. This arrangement shows that an MS unit can be installed at almost any surface where the web 44 passes.

This invention saves energy and at the same time, improves the operability of the paper making machine. The production of 1 kilogram of paper requires the removal of 200 kilograms of water from the aqueous dispersion of pulp. At the beginning of the process there is a fiber concentration of 0.5% which is concentrated to about 96% at the end of the process.

A need for a good product requires a consistently reliable process that produces the product in the shortest time, because the production per hour influences the selling price, and the selling price influences the business.

Seen in its broadest point of view a paper mill is a large filter that tries to filter a watery pulp in the shortest possible time; starting with a dispersion of fiber in water at a concentration of about 0.5%, we can see the water line visible over the fabric wire with 3% drainage, thence with an artificial means, such as air at negative pressure, we try to drain as much water as possible in the shortest time, and very quickly we reach the limit of the drainage over the fabric wire at a dryness of about 18–20% using the fabric wire process; and to go farther we must change from the fabric wire process to a felt process to obtain a web which is transmitted to the press area where the web is twice pressed hard, over the felt by pressing between two cylinders, which by capillary action removes the last free water; the felt is discharged and carries away the last few drops of water, the expensive pressure treatment having increased the drainage to about 38–50%. The internal meniscus and the external meniscus surfaces are now joined together around the fibers and no mechanical force can take off the remaining water. The only method available to remove the water is to employ the expensive thermal energy to dry the web in the paper machine dryer section. There are eternal problems about time, cost and the quality of the finished paper, and these problems have not been resolved. In the dryer section large heater cylinders are used as rotating rolls transporting the web wound around them and running from one to another with a path 6 or 7 times longer than that over the wire. The dryers are heated by steam and the steam consumed in drying is about 3.5 kilograms of steam per 1 kilogram of paper and the cost is enormous. The dryer section is the element of the paper making process which determines the maximum speed of the machine for each type of paper in production.

The energy cost, plus the cost of the fiber and other production costs determines the selling price. The dryer section is based on obtaining maximum heat transfer by known technologies and has reached the maximum range of production permitted by the physical laws of science. Indeed, the wet web is in contact with the hot surface of the cylinder, the heat evaporates the water and transfers the steam into the felt's volume, which becomes saturated very quickly, reducing the drying capacity. When the web leaves one cylinder to reach the following cylinder the sheet loses heat and the evaporation process is interrupted repeatedly. This alternating hot and cold loses time and efficiency in the drying process. The drying process is conditioned on coefficients of the transfer of heat, between metal and paper, paper and felt; the saturation temperature of the steam in the dryer hood; the ambient temperature of the dry section and the relative humidity curve; all of these elements are combined in order to obtain high efficiency of a large volume of BTU's expended and the efficiency of the drying system is only about 25%.

The physical law requires that for evaporation to occur, the web has to be exposed to heat and this is done by having the web in contact with the surface of a hot cylinder. The other face of the sheet, that is in contact with the felt, should be maintained dry for better evaporation. This is accomplished by the apparatus of FIG. 6 which can be distributed in ten or more positions throughout the dryer section 172 downstream of FIG. 2. One roll 160 with its felt fabric 171 carrying paper web 44 being shown, for example, with the meniscus separator unit 173 associated therewith to further assist in drying felt fabric 171.

Heated cylinder 201 and the felt or fabric 200 sandwich the wet web of fibers therebetween and the heat from the cylinder 201 transforms the water captured by the fibers into steam which transmigrates across the porosity of the wet web into the fabric 200. The ambient air entering the MS unit transforms the steam in the fabric 200 to a fog which is readily extracted from the fabric 200 by the flow of air through the thickness of the fabric and small vacuum supplied by the MS unit. The wet web of fibers is pressed more against the cylinder 201 by the fabric 200 via air entering at nose 207 and exiting channel 206, evaporating the water in the wet web of fibers to create steam and condensing the steam into fog in the fabric 200, which is easily removed by the MS unit. The prior art seeks to remove the steam in the drying fabric by blowing hot air over the fabric requiring an expenditure of costly energy in a less efficient manner.

The MS produces an effect which is similar to that produced by an aircraft wing, wherein the top side profile produces a large area of vacuum which supports the plane in the air. In FIG. 6 indeed, the jet of air penetrates the felt a short distance inwardly and then must curve to return to the outside. This creates a vacuum which causes the water in the paper to evaporate instantly, and leave the area thus producing a dry area. The hot surfaces of the cylinders produces this effect which provides an admirable way to finish the paper web and efficiently utilize the hot surfaces which might otherwise be and expensive feature.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A method of removing water from an aqueous fiber dispersion formed into a wet web of fibers in contact with an outer surface of fabric in a paper making process having sequentially a forming section including a wet end portion and a dry end portion, a press section and a dryer section which comprises the sequential steps of:

(a) passing the wet web of fibers and the fabric above and in sliding contact with a surface of a meniscus separator unit having a plurality of spaced cells in contact with the inner surface of the fabric;

(b) applying a small vacuum to an internal space of each cell of the meniscus separator unit to extract water from the wet web using the tension meniscus of water while preventing air from passing through the wet web; and (c) permitting air from the atmosphere only to be applied to the inner surface of the fabric to each cell of the meniscus separator unit and thence into the fabric to replace the water removed from the fabric in step (b) thereby enhancing the removal of water from the web and water from the fabric, the atmospheric air passing along and through the interstices between the inner and outer surfaces of the fabric to the internal space of each cell.

2. The method of claim 1 wherein step (c) is located upstream from step (b), wherein the air from step (c) travels in an inclines path from the inner surface of the fabric and towards the direction of travel of the fabric and thence generally through the fabric in the direction of travel of the fabric.

3. The method of claim 1 wherein step (b) is located downstream from step (c), wherein the extraction of water from the wet web is via the fabric enhanced by the air from step (c) and removed through an inclined path away from the fabric.

4. The method of claim 1 wherein step (c) is located upstream from step (b) whereby the air from step (c) travels in the same direction as the fabric and enhances the removal of water from the web.

5. The method of claim 1 wherein step (b) is located downstream from step (c), wherein the extraction of the water from the wet web is accomplished by capillary forces in the fabric in contact with the wet web by the movement of the atmospheric air penetrating the interstices of the fabric along its length through an inclined path and passing along a nose in contact with the inner surface of the fabric and replacing and forcing water from the fabric into a chamber downstream of the nose in which step (b) is applied.

6. The method of claim 5 wherein step (b) is applied to the fabric at the nose downstream of the inclined path and nose and in contact with the nose on another inclined path away from the fabric and nose.

7. The method of claim 1 wherein the fabric is a Fourdrinier wire fabric.

8. The method of claim 1 wherein the meniscus separator unit is downstream from a head box containing the aqueous fiber dispersion.

9. The method of claim 1 wherein the meniscus separator unit is adjacent and upstream from the couch roll in the paper making process.

10. The method of claim 9 wherein a plurality of additional meniscus separator units are spaced along the dry end portion of the paper making process.

11. The method of claim 1 wherein the meniscus separator unit is disposed in the dryer section of the paper making process.

12. The method of claim 1 wherein the meniscus separator unit is disposed in the press section of the paper making process.

13. The method of claim 1 wherein an additional separator unit has a surface in sliding contact with an outer surface of the fabric in the press section of the paper making process to dry and condition the outer surface.

14. A method of removing water from a wet web of fabric material having a first and a second opposite surface which comprises the sequential steps of:

(a) passing the first surface of the wet web of fabric material in sliding contact with a working surface of a meniscus separator unit having a plurality of internal cells communicating with passageways in the working surface;

(b) applying a small vacuum to an internal space in each cell of the meniscus separator unit to extract water from the wet web of fabric material while preventing air from passing through the web of fabric material from its second surface; and (c) permitting air from the atmosphere only to be applied to the first surface of the wet web of fabric material to each cell of the meniscus separator unit and thence into the web of fabric material to replace the water removed from the web in step (b) thereby enhancing the removal of water from the wet web of fabric material, the atmospheric air passing along and through the interstices between the first and second surfaces of the wet web of fabric material to the internal space of each cell of the meniscus separator unit.

15. The method of claim 14 wherein the wet web of fabric material carries a wet fibrous web of paper on its surface not in sliding contact with the working surface.

16. The method of claim 15 wherein the meniscus separator unit is located in any section of a Fourdrinier paper making process.

17. The method of claim 16 wherein a plurality of additional meniscus separator units are spaced along more than one section.

18. A method of removing water from an aqueous fiber dispersion formed into a wet web of fibers in contact with an outer surface of felt fabric in a paper making process having sequentially a forming section including a wet end portion and a dry end portion, a press section and a dryer section which comprises the sequential steps of:

(a) passing the wet web of fibers and the felt fabric above and in sliding contact with a surface of a meniscus separator unit having a plurality of spaced cells in contact with the inner surface of the felt fabric;

(b) applying a small vacuum to an internal space of each cell of the meniscus separator unit to extract water from the wet web using the tension meniscus of water while preventing air from passing through the wet web; and (c) permitting air from the atmosphere only to be applied to the inner surface of the felt fabric to each cell of the meniscus separator unit and thence into the felt fabric to replace the water removed from the felt fabric in step (b) thereby enhancing the removal of water from the web and water from the felt fabric, the atmopheric air passing along and through the interstices between the inner and outer surfaces of the felt fabric to the internal space of each cell.

19. The method of claim 18 wherein a moving surface is located on the outer surface of the wet web of fibers opposite to the meniscus separator unit.

20. The method of claim 19 wherein the moving surface is a solid moving surface.

21. A method of removing water from an aqueous fiber dispersion formed into a wet web of fibers in contact with an outer surface of fabric in a paper making process having sequentially a forming section including a wet end portion and a dry end portion, a press section and a dryer section which comprises the sequential steps of:

(a) passing the wet web of fibers and the fabric above and in sliding contact with a surface of a meniscus separator unit located where the wet web engages a granite roll in the press section and having a curved surface with a plurality of spaced cells in contact with the inner surface of the fabric;

(b) applying a small vacuum to an internal space of each cell of the meniscus separator unit to extract water from the wet web using the tension meniscus of water while preventing air from passing through the wet web; and (c) permitting air from the atmosphere only to be applied to the inner surface of the fabric to each cell of the meniscus separator unit and thence into the fabric to replace the water removed from the fabric in step (b) thereby enhancing the removal of water from the web and water from the fabric, the atmospheric air passing along and through the interstices between the inner and outer surfaces of the fabric to the internal space of each cell.

22. A method of removing water from an aqueous fiber dispersion formed into a wet web of fibers in contact with an outer surface of fabric in a paper making process having sequentially a forming section including a wet end portion and a dry end portion, a press section and a dryer section which comprises the sequential steps of:

(a) passing the wet web of fibers and the fabric above and in sliding contact with a surface of a meniscus separator unit located adjacent a hot surface of a cylinder with the web of fibers being sandwiched between the cylinder and the fabric and the meniscus separator unit having a plurality of spaced cells in contact with the inner surface of the fabric;

(b) applying a small vacuum to an internal space of each cell of the meniscus separator unit to extract water from the wet web using the tension meniscus of water while preventing air from passing through the wet web;

(c) permitting air from the atmosphere only to be applied to the inner surface of the fabric to each cell of the meniscus separator unit and thence into the fabric to replace the water removed from the fabric in step (b) thereby enhancing the removal of water from the web and water from the fabric, the atmospheric air passing along and through the interstices between the inner and outer surfaces of the fabric to the internal space of each cell; and (d) transmitting heat from the cylinder to the web of fibers to transform water captured by the fibers into steam which transmigrates across the web's porosity into the fabric, the air from step c transforming the steam in the fabric to a fog readily extracted by the unit from the fabric via step b.

23. A method of removing water from a wet web of fabric material having a first and a second opposite surface which comprises the sequential steps of:

(a) passing the first surface of the wet web of fabric material in sliding contact with a working surface of a meniscus separator unit located adjacent a hot surface of a cylinder with a web of fibers being sandwiched between the cylinder and the fabric and the meniscus separator unit having a plurality of internal cells communicating with passageways in the working surface;

(b) applying a small vacuum to an internal space in each cell of the meniscus separator unit to extract water from the wet web of fabric material while preventing air from passing through the web of fabric material from its second surface;

(c) permitting air from the atmosphere only to be applied to the first surface of the wet web of fabric material to each cell of the meniscus separator unit and thence into the web of fabric material to replace the water removed from the web in step (b) thereby enhancing the removal of water from the wet web of fabric material, the atmospheric air passing along and through the interstices between the first and second surfaces of the wet web of fabric material to the internal space of each cell of the meniscus separator unit; and (d) transmitting heat from the cylinder to the web of fibers to transform water captured by the fibers into steam which transmigrates across the web's porosity into the fabric material, the air from step c transforming the steam in the fabric material to a fog readily extracted by the unit from the fabric material via step b.

* * * * *